US006639137B2

(12) United States Patent
Lauer

(10) Patent No.: US 6,639,137 B2
(45) Date of Patent: Oct. 28, 2003

(54) GUITAR STRING CHANGING TOOL KIT

(76) Inventor: Patrick M. Lauer, 181 Regina Street North, Waterloo, Ontario N2J 3B4 (CA)

( * ) Notice: Subject to any disclaimer, the term of this patent is extended or adjusted under 35 U.S.C. 154(b) by 0 days.

(21) Appl. No.: 10/051,152

(22) Filed: Jan. 22, 2002

(65) Prior Publication Data

US 2003/0136246 A1 Jul. 24, 2003

(51) Int. Cl.[7] ..... G10G 7/02
(52) U.S. Cl. ..... 84/453
(58) Field of Search ..... 84/453, 458, 454; 206/372, 373, 374, 375

(56) References Cited

U.S. PATENT DOCUMENTS 5,152,441 A * 10/1992 Torena ..... 224/153
5,203,469 A * 4/1993 Chang et al. ..... 220/812
5,613,413 A * 3/1997 Huang ..... 81/490
6,294,719 B1 * 9/2001 Palecki et al. ..... 84/458

OTHER PUBLICATIONS

Printout of Internet web page from www.musiciansfriend-.com regarding "Musician's Friend Accessory Package (#420402)" and contact address for Musician's Friend, Inc.

* cited by examiner

*Primary Examiner*—Shih-Yung Hsieh
(74) *Attorney, Agent, or Firm*—R. Craig Armstrong; Borden Ladner Gervais LLP

(57) ABSTRACT

A musical instrument string changing kit has a box with a lid and a tool receiving portion. Tools are stored in shaped recesses in the tool receiving portion, and a secret compartment is arranged on an inside of the lid.

20 Claims, 11 Drawing Sheets

GUITAR STRING CHANGING TOOL KIT

FIELD OF THE INVENTION

The present invention relates generally to tools for use with musical instruments. More particularly, the present invention relates to a tool kit for changing strings on a stringed musical instrument, such as guitars, lutes, mandolins etc.

BACKGROUND OF THE INVENTION

Traditionally, a musician or other user of a stringed musical instrument (hereinafter called "user") typically has provided his or her own tools for string changing from a variety of sources. After procuring the individual tools, the user further had to provide some type of storage for the tools, often resorting to storing them lose inside an instrument case, possibly in a pouch or tied together with a rubber band. Although some cases may have separate compartments for tools and accessories, the tools are still free to loosely tumble within the compartment, making it difficult to create any permanent order, which is important for ease of access and, thus, of use. Moreover, small items, such as small screwdrivers or plectrums, are easily damaged or lost, using this storage method. If a user has invested in the high quality tools needed by a professional musician in his or her quest to properly maintain their tool-of-the-trade, or for other reasons, these high-quality tools represent a significant investment and should be protected when not in use.

It is, therefore, desirable to provide a means of secure storage of the tools, as well as providing an ordered storage for ease of use.

SUMMARY OF THE INVENTION

It is an object of the present invention to obviate or mitigate at least one disadvantage of previous described tool storage alternatives.

In a first aspect, the present invention provides a tool kit, for use with a musical instrument, the tool kit comprising a tool case with a bottom portion and a lid. The lid is hinged to the bottom portion along one side, so that the lid is pivotable between a closed position and an open position. In the open position, access is provided to an inside of the bottom portion. The bottom portion has shaped recesses for accepting specific tools: such as a cutting tool; a winding tool; a container for plectrums; at least one screwdriver bit; and a holder for screwdriver bits.

The winding tool has a hollow handle with a removable end cap. The hollow handle and removable end cap, when attached to the handle, defining a container for storage of the screwdriver bit(s).

Preferably, the end cap has a slotted recess for removal of bridge pins from a musical instrument, by using the end cap, mounted on the hollow handle, as a prying tool.

Advantageously, the winding tool has a curved portion to prevent contact with adjacent machine heads when the winding tool is applied to a machine head for winding a string.

Alternatively, the hollow handle of the winding tool is used for storage of the screwdriver bit(s) and the holder for screwdriver bits. Preferably, the screwdriver bit holder is in two parts, which can be attached together, to further facilitate the storage of the screwdriver bit holder in the winding tool handle.

The cutting tool is preferably a pair of cutting pliers, for instance a diagonal cutting pliers.

Advantageously, the holder for screwdriver bits has a socket, for non-rotatably receiving one of the screwdriver bits, to allow a user to apply torque to the bit by way of the holder. The holder for screwdriver bits preferably has locking means for locking the screwdriver bit in the longitudinal hole, for example a collar threaded onto the screwdriver bit holder.

The container for plectrums is preferably a stainless steel box.

The lid is preferably held in the closed position by magnetic means arranged on the lid and the bottom portion.

The tool kit further advantageously comprises a tuning fork.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
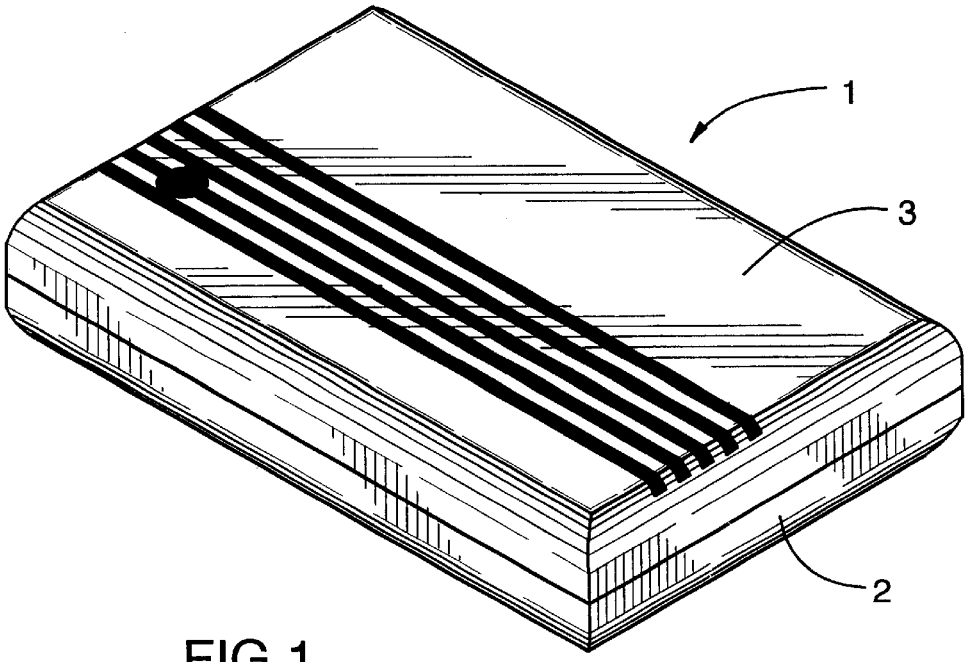
FIG. 1 is an elevational perspective view of a tool case according to the invention, showing the lid in its closed position.
Figure 2:
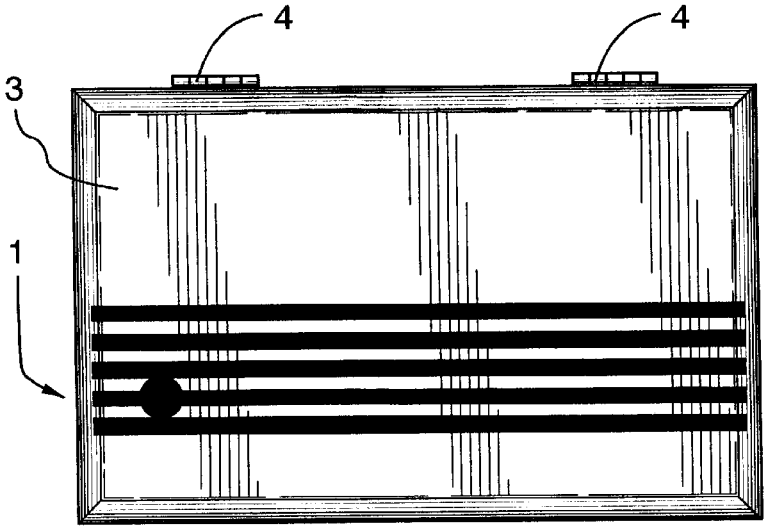
FIG. 2 is a top plan view of the tool case shown in FIG. 1.
Figure 3:
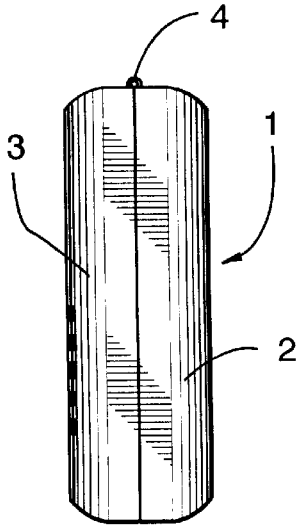
FIG. 3 is a plan end view of the tool case shown in FIG. 1.

Generally, the present invention provides a kit for changing strings on a stringed musical instrument, as well as for performing simpler maintenance of hardware attached to the instrument.

As is shown in FIGS. 1 to 7, the string changing kit according to the invention has a box 1 with a bottom portion 2 and a lid 3. The lid is pivotably attached to the bottom portion, for example via hinges 4. The lid is thus pivotable between a closed position (see FIG. 1) and an open position (see FIG. 4). Advantageously, the lid 3 is biased towards the bottom portion 2 in the closed position of the lid by locking means 5, 6. The locking means are preferably a first magnet 5 arranged on an inside surface 7 of the lid, and a second magnet 6 arranged on a corresponding location on an inside surface 8 of the bottom portion. In the preferred embodiment of the invention, a first steel cup 5' is pressed into a pre-drilled hole in the lid and a second steel cup 6' is pressed into a pre-drilled hole in the bottom portion. The first magnet 5 is then inserted into the first steel cup and held in the cup by magnetic forces. The magnetic field of the first magnet is enhanced by the steel cup, typically ten-fold. Similarly, the second magnet 6 is inserted into the second steel cup 6'. The magnets are advantageously rare earth magnets, or of any other type that will provide the necessary magnetic field to hold the lid and bottom portion together, when the lid is in its closed position. Other alternative locking means are possible to use, for example mechanical latches or hooks, but the unobtrusive appearance provided by magnetic locking means as shown in the Figs. enhances the exclusivity image of the tool kit.

Figure 11:
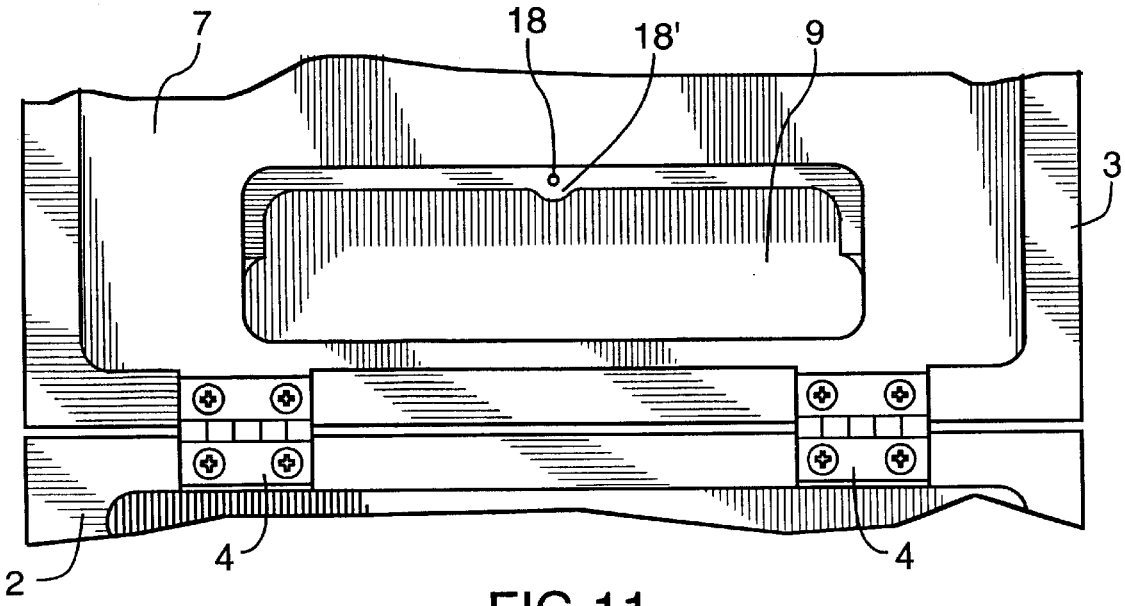
FIG. 11 is a top plan view of a further embodiment of a tool case according to the invention, showing the secret compartment cover hold-down magnet arranged in a bulge.
Figure 12:
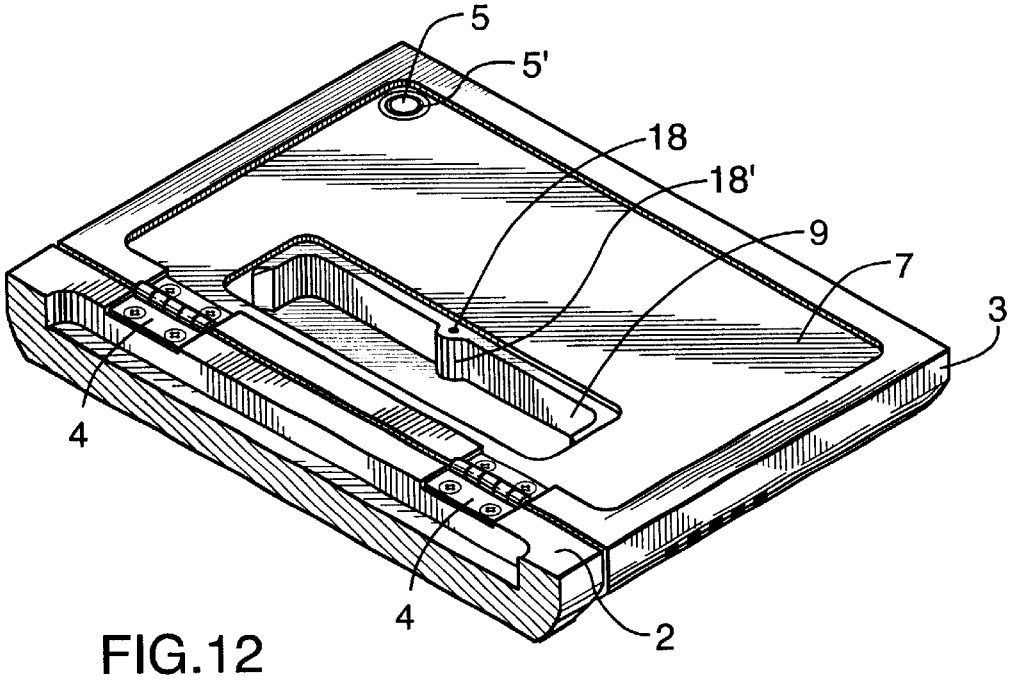
FIG. 12 is an elevational perspective view of the tool case shown in FIG. 11.

The inside surface 7 of the lid 3 is preferably recessed with a secret compartment 9 covered by a removable cover 10. The cover is preferably made of a magnetic material, for instance brass plated steel, and held in place, when placed over the secret compartment, by a powerful cover hold-down magnet 18. Again, the magnet is advantageously a rare earth type magnet. The secret compartment can be used to store, for example, keys or other smaller items out-of-sight. Any items, which are to be kept sufficiently well hidden from view, are thus suitable for storing in the secret compartment. In an alternative embodiment, as shown in FIGS. 11 and 12, the cover hold-down magnet 18 is arranged in a bulge 18', this being the preferred embodiment. The bulge provides ample space for holding the magnet.

Figure 8:
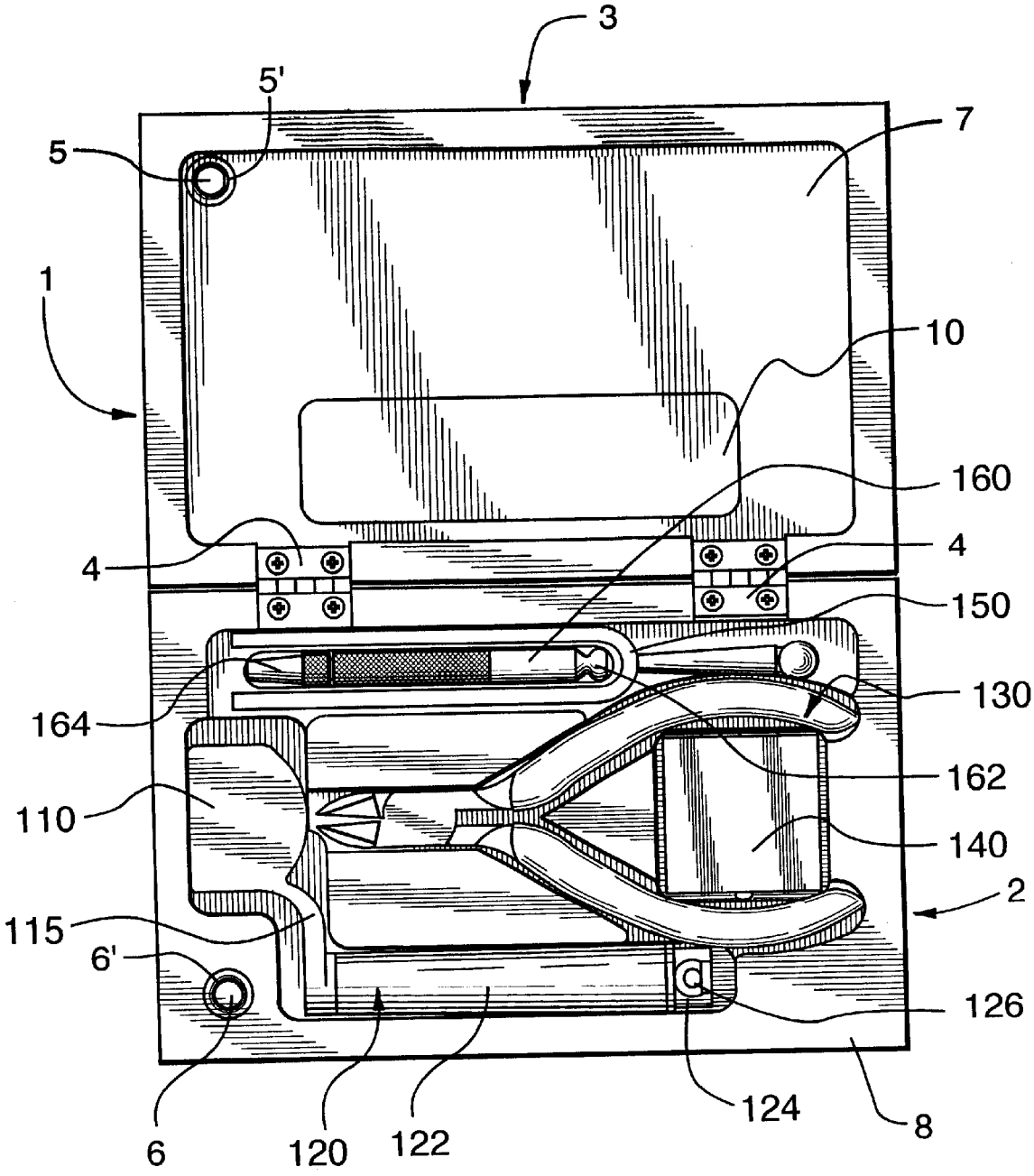
FIG. 8 is a top plan view of the tool case shown in FIG. 4, shown with tools placed in their respective recesses.
Figure 9:
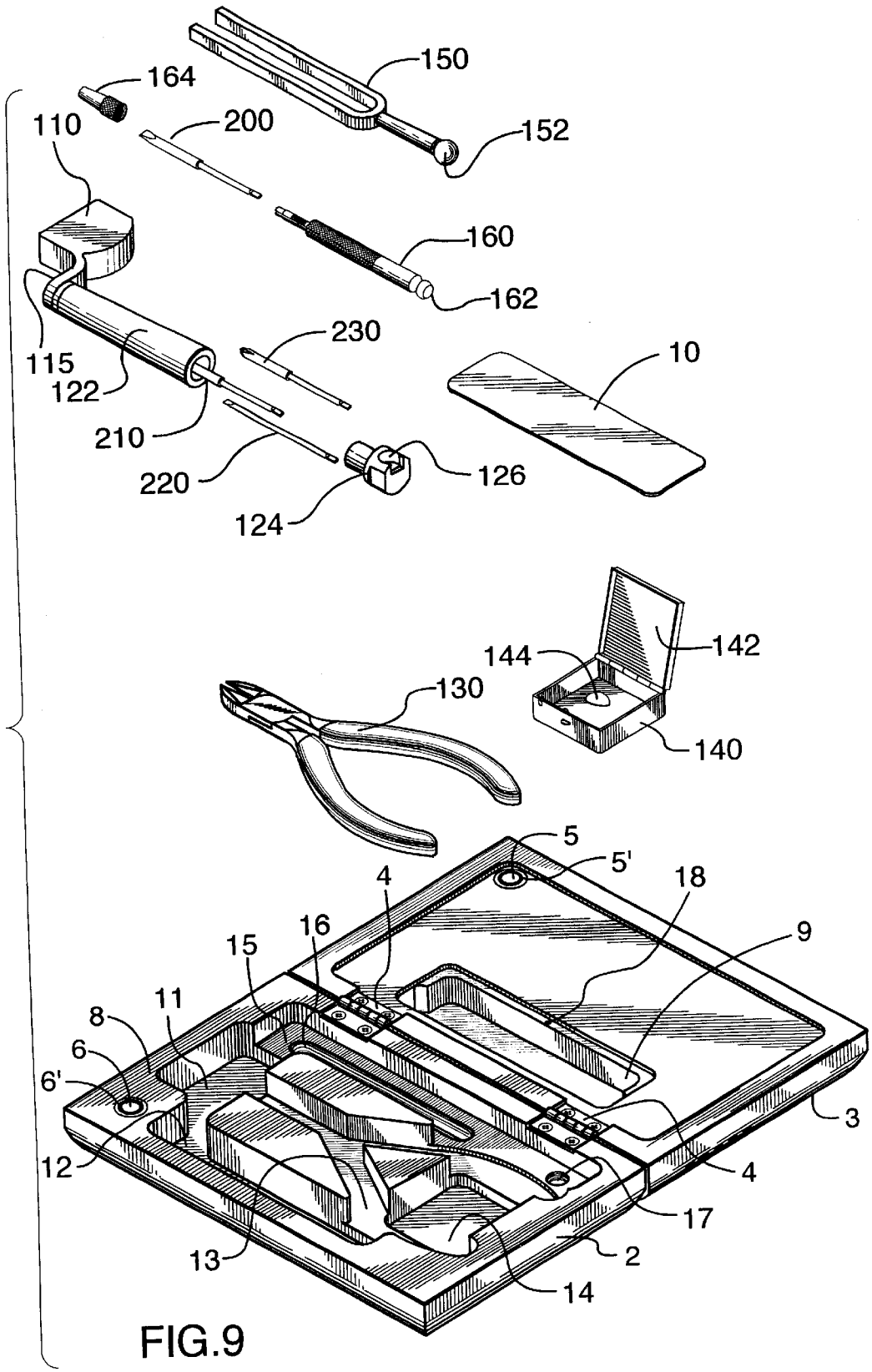
FIG. 9 is an elevational exploded perspective view of the tool case shown in FIG. 8, showing tools in a disassembled state.
Figure 10:
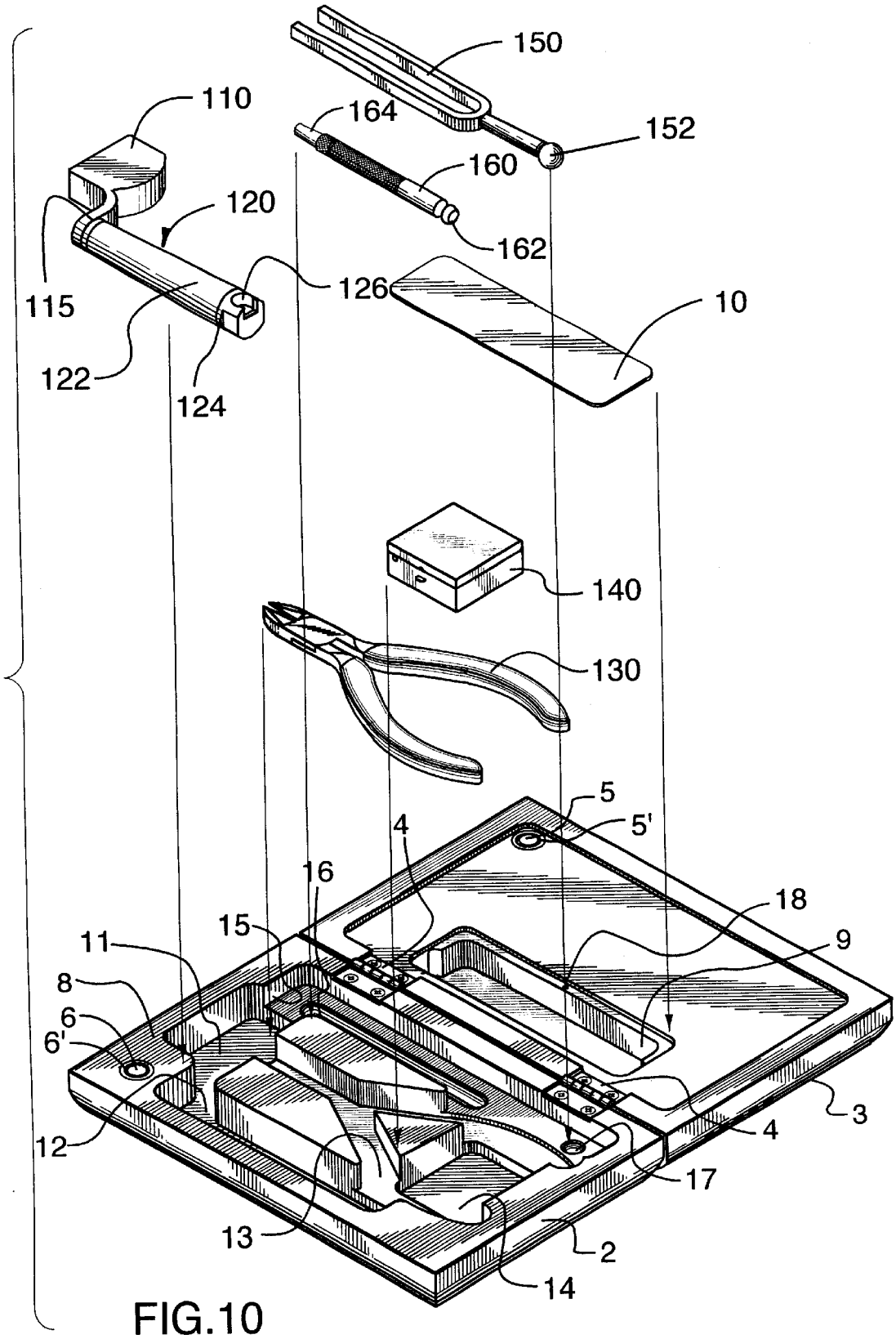
FIG. 10 is an elevational exploded perspective view of the tool case shown in FIG. 8, showing tools in an assembled state ready to be placed in their respective recesses in the tool case.

The bottom portion 2 has a plurality of tool recesses 11, 12, 13, 14, 15, 16, 17, respectively, for securely holding a tool in place, when the tool is stored in the box 1. The tool recesses are arranged in the bottom portion to minimise the required space, to provide as compact a box 1 as possible. The individual tools envisioned for use with the tool kit according to the invention are shown in FIGS. 8 to 10, and are a string winder 120, a cutting pliers 130, a plectrum (pick) storage container 140, a tuning fork 150 and a screwdriver handle 160 with a plurality of screwdriver bits 200, 210, 220, 230 (see FIG. 9).

The string winder 120 has a hollow handle 122 with a removable end cap 124 and a head 110 attached to the handle via a curved stem 115. The head is to be placed over the winding grip of a machine head (not shown) of a guitar (not shown), and the user will grip the handle and wind the machine screw by using the string winder as a crank. The end cap preferably has a cut-out 126 to enable the user to utilise the string winder with attached end cap for prying lose and removing bridge pins (not shown) from the guitar. The hollow handle 122 is used to store the screwdriver bits, when they are not used. By attaching the end cap to the handle, the bits will be securely stored inside the handle. Preferred screwdriver bits are a small flat bit 220, a large flat bit 200, a small cross bit 210 and a large cross bit 230. Other combinations are possible, for special purposes, for example Allen type bits (not shown) and Torqx (TM) type bits (not shown). The string winder is placed in the bottom portion 2 in a string winder recess 12 having a special head recess 11.

The cutting pliers 130 are preferably a diagonal cutting pliers and preferably made from high carbon drop forged steel. The material is further preferably heat-treated for enhanced strength and long-life cutting edges. The grips are advantageously covered with grip enhancing material, such as soft plastic. The cutting pliers are placed in the bottom portion 2 in a cutting pliers recess 13.

The plectrum storage container 140 is preferably made from stainless steel, to enhance the visual appeal of the whole kit. Other alternative materials are plastic, brass and wood, for example. The plectrum storage container is placed in the bottom portion 2 in a plectrum storage container recess 14. The kit is advantageously delivered to the end user with an assortment of plectrums in the container.

The tuning fork 150, for example a standard A 440 Hz tuning fork, is placed in the bottom portion 2 in a tuning fork recess 15. The tuning fork has an end ball 152, which is accommodated in a ball recess 17, to keep the fork centred in its recess. The tuning fork can be excluded from the kit, since it is not strictly necessary for string changing and light maintenance of the musical instrument. The preferred kit has the tuning fork as one tool. An alternative tuning aid is any type of electronic tuning device (not shown), which can fit in the box. The electronic tuning device can, for example, be permanently stored in the lid or be shaped to fit in its own shaped recess (not shown). One particular example is an electronic tuning device having a circuit board with electronic components attached to the lid and preferably covered to not be visible. A display (not shown) is connected to the circuit board and attached to an inside of the lid, for display of tuning help information. A microphone (not shown) or an electric input (not shown) may be used to provide the tuning signal to the device. As is well known, properly tuned strings are essential to achieving a properly set up instrument. For example, when tuning strings on a guitar, the tension of the strings determine how much the truss rod of the guitar neck is to be tightened to provide the proper "action" of the guitar (the proper distance between the strings and the fret-board).

The screwdriver bit holder 160 has a longitudinal internal hole for receiving one of the screwdriver bits. The holder further has locking means 164 for locking the screwdriver bit in the longitudinal hole. The locking means is, for instance, a collar threaded onto the screwdriver holder, to squeeze the bit in place when the collar is tightened. The screwdriver bit holder is placed in the bottom portion 2 in a screwdriver bit holder recess 16. The holder is advantageously stored, and the holder recess arranged, between the two parts of the forked end of the tuning fork, when the fork is stored in the tuning fork recess.

An alternative embodiment of the invention has a winder where also the screwdriver bit holder is stored in the winder handle. In this embodiment, the screwdriver bit handle recess is not necessary, of course. The winder, with its screwdriver bit handle and assorted screwdriver bits, is either sold as a separate unit from the kit or together with the kit substantially as described earlier. To further facilitate the storage of the screwdriver bit holder in the winder handle, the screwdriver bit holder is preferably made in two parts, which can be attached together.

The tools are thus made easily accessible to the user, both in terms of finding them in one and the same location and orientation as they were when put in storage, as well as providing a portable storage. The arrangement of the shaped recesses further provides a space-efficient storage, using the least amount of space for a compact tool box.

The box 1 is preferably made of wood, for example walnut, cherry, mahogany, maple or other hardwoods, which have pleasing textures and colours. A design is preferably applied on the lid, preferably made from a material contrasting in colour with the lid material, for example ebony (or black painted wood) for lighter lid materials or birch or maple for darker lid materials. Alternatively, the box may be made from a plastic material, for instance injection moulded.

Figure 4:
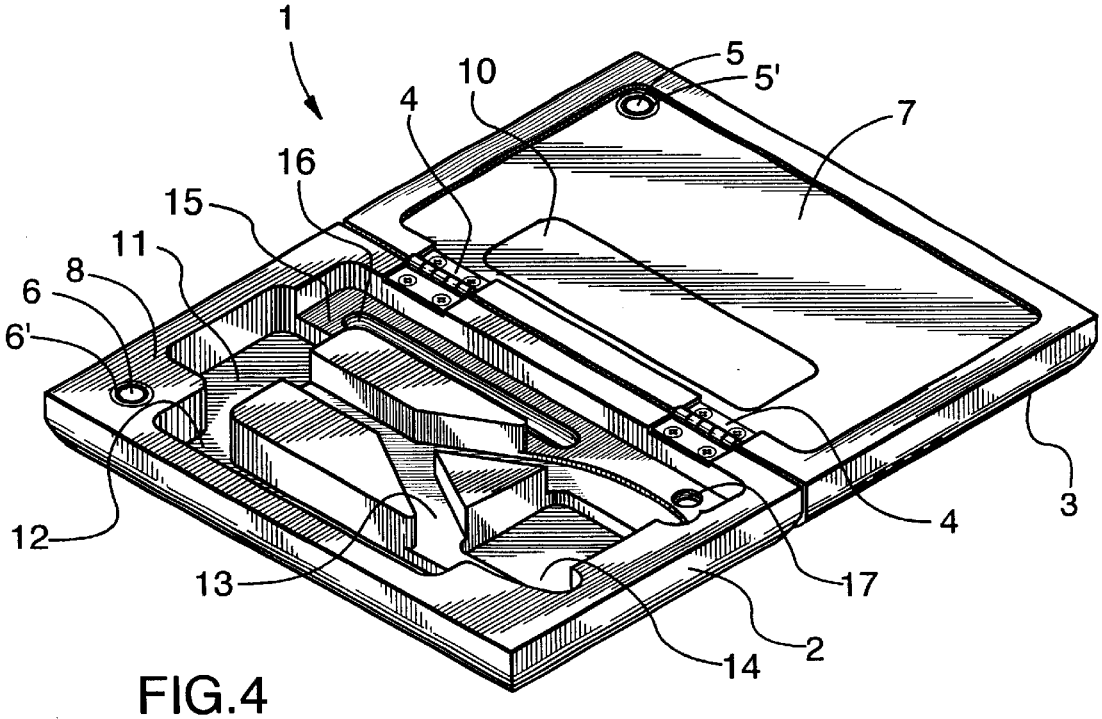
FIG. 4 is an elevational perspective view of a tool case according to the invention, showing the lid in an open position.
Figure 5:
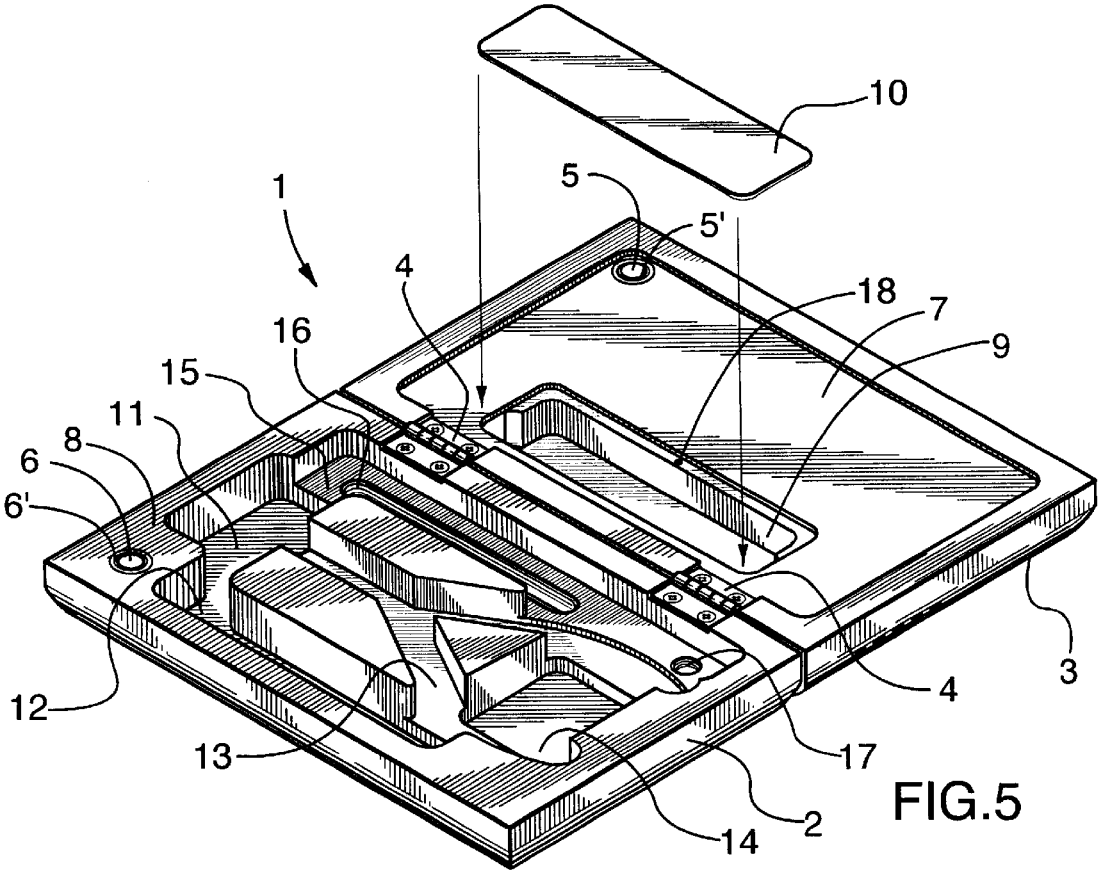
FIG. 5 is an elevational perspective view of the tool case shown in FIG. 4, showing a cover for a hidden compartment in a removed position.
Figure 7:
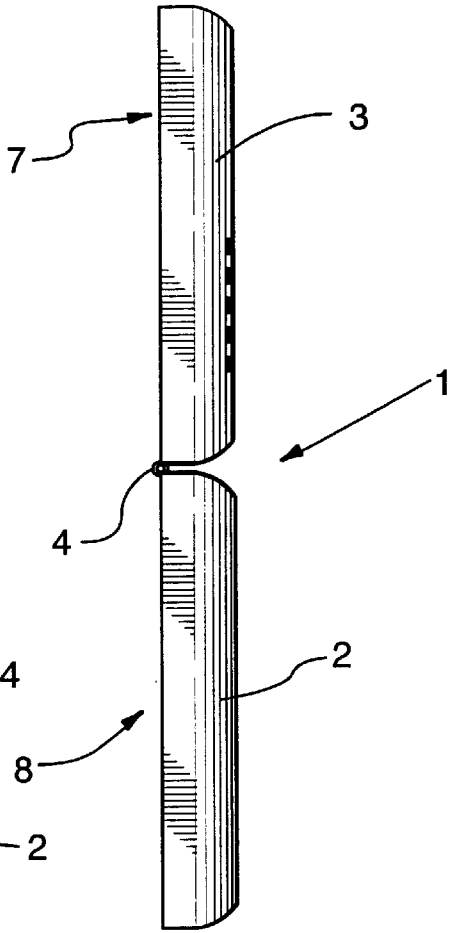
FIG. 7 is a plan end view of the tool case shown in FIG. 4.
Figure 6:
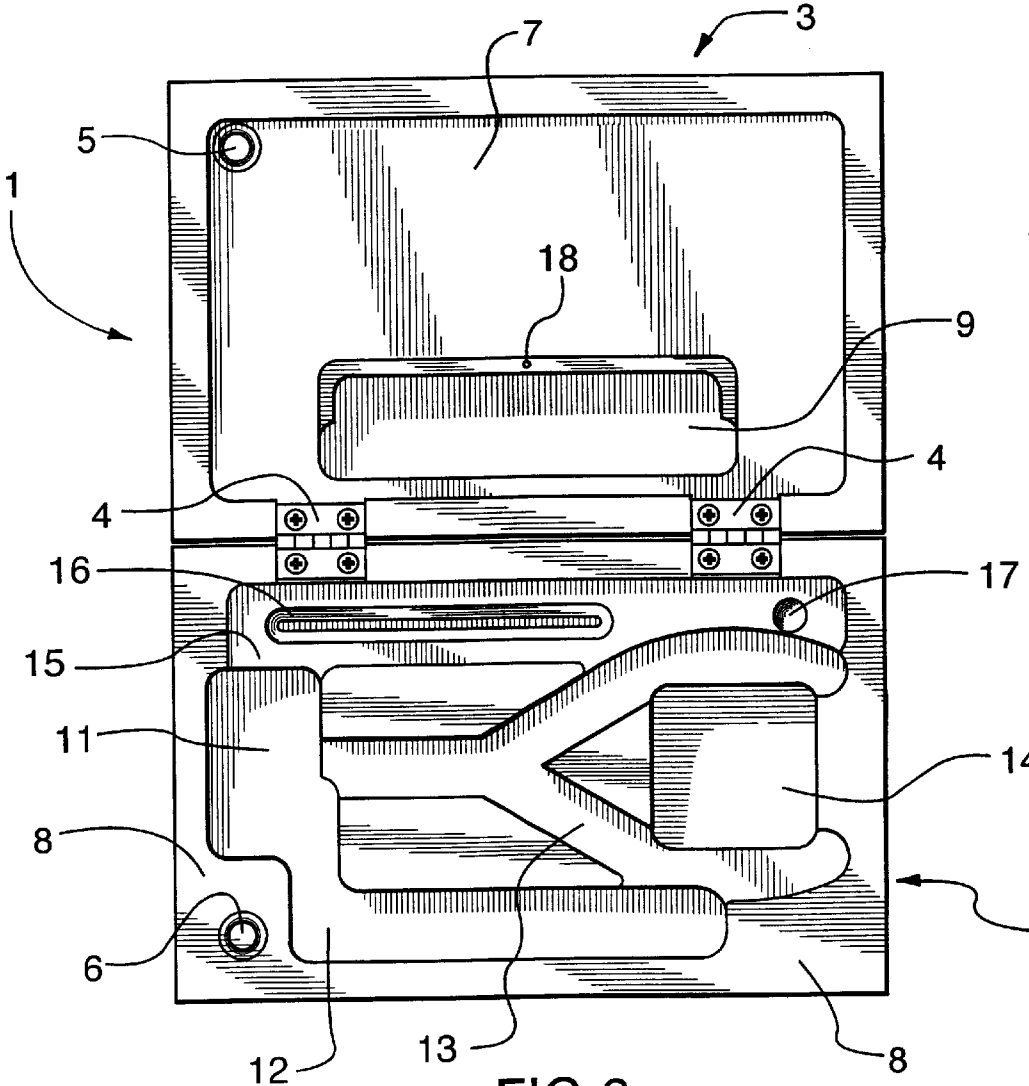
FIG. 6 is a top plan view of the tool case shown in FIG. 4.

FIGS. 13 to 19 illustrate the use of the removable cover plate 10 covering the secret compartment 9. To an uninformed observer, cover 10 is merely a decorative plate. In one embodiment, the cover can be engraved so that it appears as a simple name plate. As illustrated in FIG. 4, cover 10 covers the secret compartment 9. The secret compartment has a raised lip 104 on which cover 10 rests. In lip 104 is the magnet 18, which serves as securing means for the cover 10, which in the present embodiment is a metallic plate. The raised lip 104 does not completely encircle compartment 9. The magnet 18 can alternatively be arranged in a protruding bulge 18' of the raised lip 104, as shown in FIGS. 11 and 12.

Figure 13:
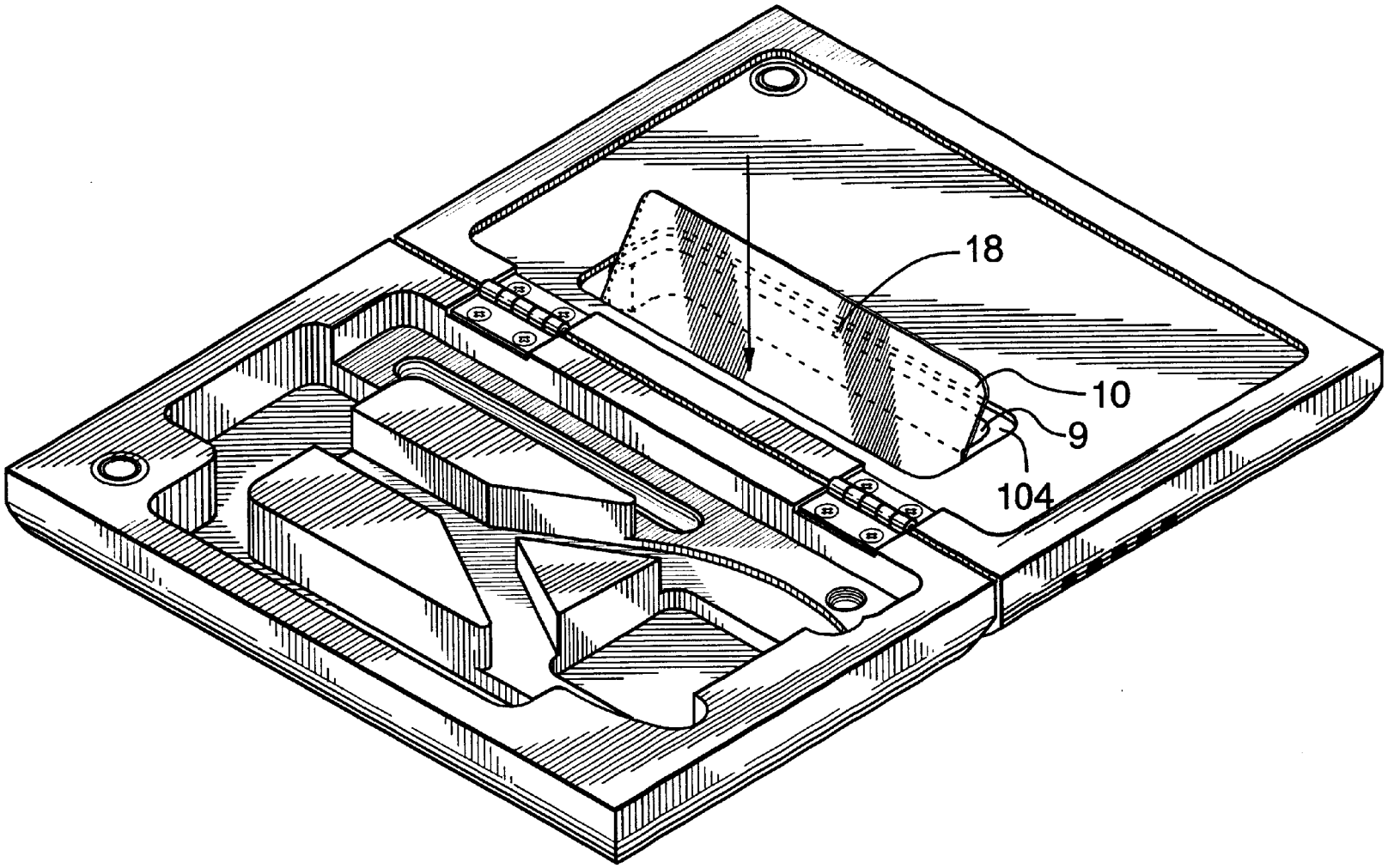
FIG. 13 is an elevational perspective view of the tool case shown in FIG. 4, where the lid is pivoted about the edge of the raised lip.
Figure 14:
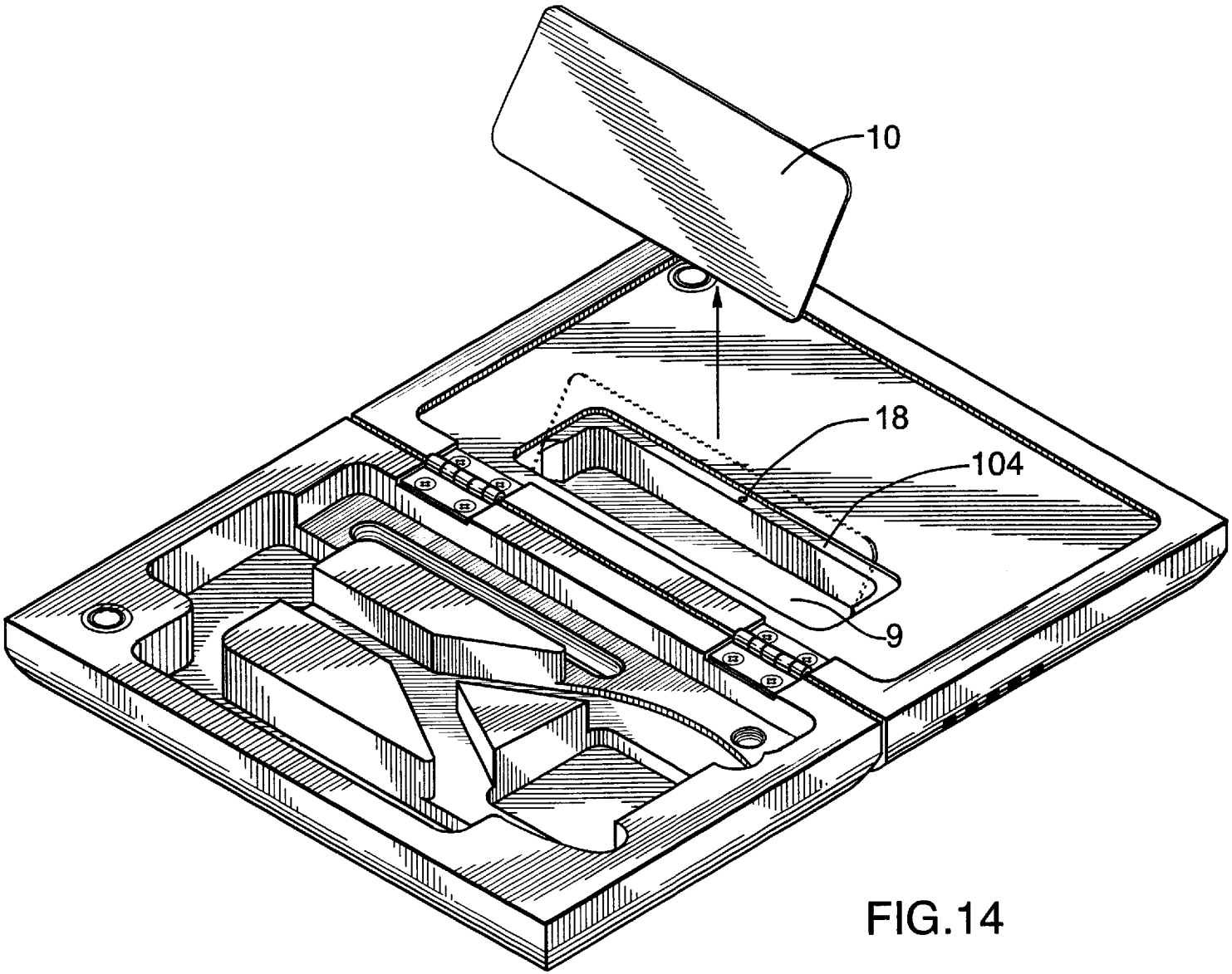
FIG. 14 is an elevational perspective view of the tool case shown in FIG. 13, where the lid is pivoted and removed from the cavity.

FIGS. 13 and 14 illustrate the removal of cover 10 from compartment 9. Pressure is applied to the cover, on the side opposite the magnet 18. Raised lip 104 does not extend to the region in which pressure is applied. As a result, cover 10 pivots about the terminal edges of raised lip 104. The terminal edges are acting as a fulcrum. Upon the application of sufficient pressure, cover 10 will separate from magnet 18, and can be removed.

Figure 15:
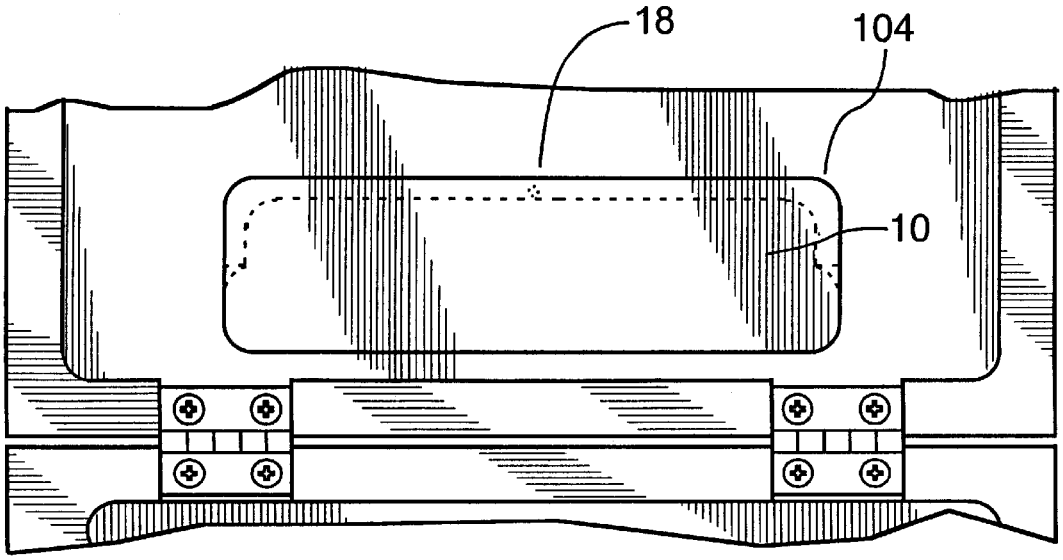
FIG. 15 is a plan detail view of the secret compartment, where the lid covers the cavity.

FIG. 15 shows compartment 9 from above with cover 10 in place, and with magnet 18 and raised lip 104 shown as hidden features.

Figure 16:
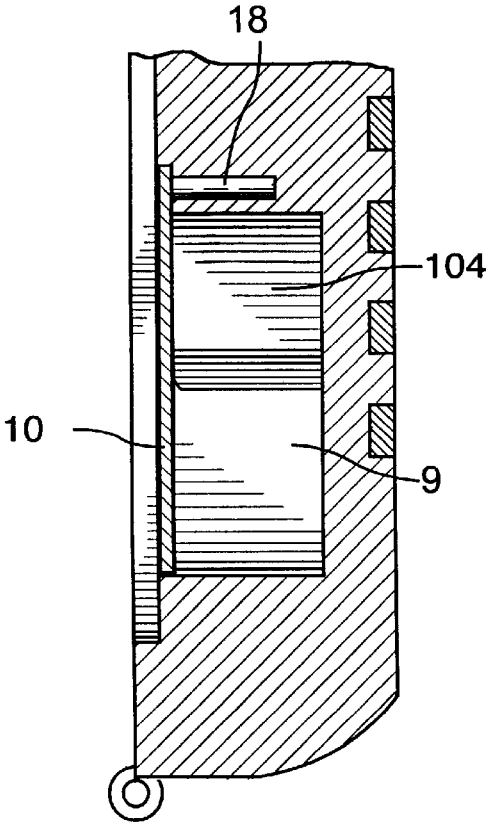
FIG. 16 is a sectional side view of the secret compartment, with the lid covering the cavity.
Figure 17:
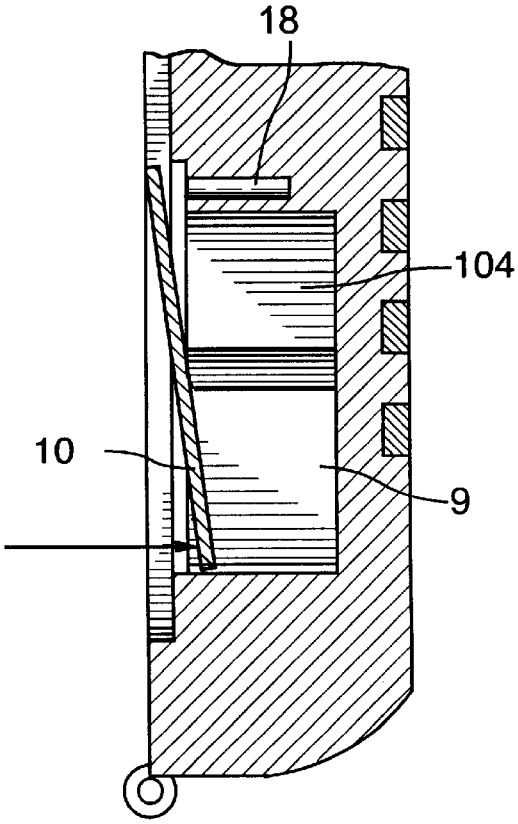
FIG. 17 is a sectional side view of the secret compartment, with the lid pivoted partly to its removal position.

FIGS. 16 and 17 illustrate compartment 9 in cross section, and cover 10 acting as a class one lever to detach from magnet 18, with the fulcrum of the lever being the edge of raised lip 104.

Figure 18:
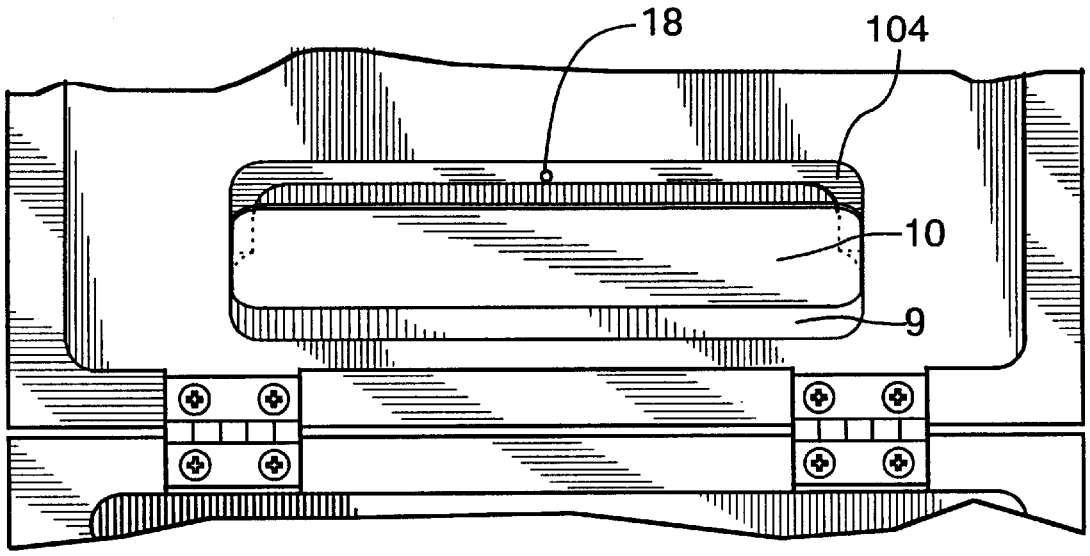
FIG. 18 is a plan detail view of the secret compartment, where the lid is pivoted.
Figure 19:
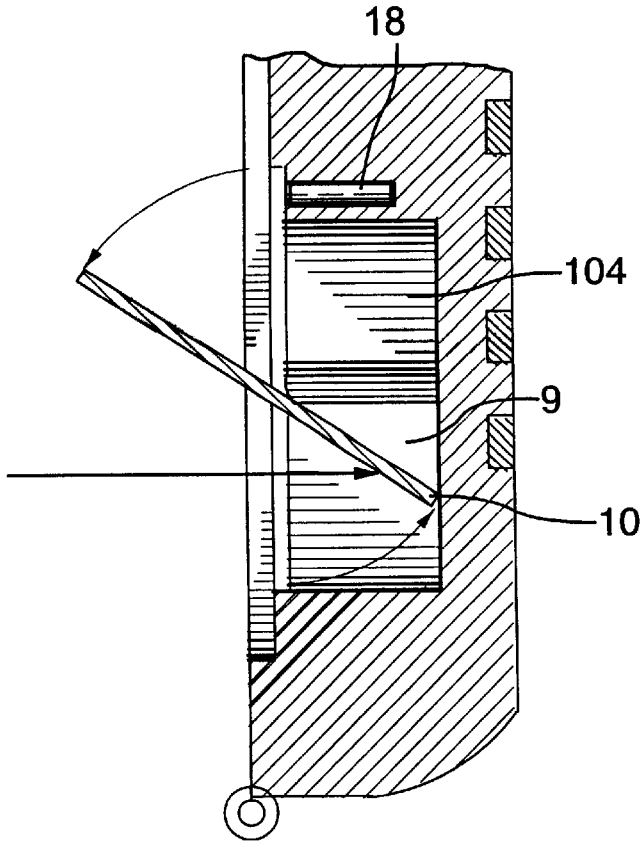
FIG. 19 is a sectional end view of the secret compartment, with the lid pivoted and ready for removal.

FIG. 18 illustrates the removal of cover 10 from compartment 9, as a top view, while FIG. 19 shows the removal in cross section.

One of skill in the art will appreciate that the exact shape and relative size of the various elements illustrated in the above mentioned figures are exemplary in nature and are not intended to limit the scope of the present invention. As an example, the raised lip 104 can be extended to reach any point along the sidewalls of compartment 9. The length of raised lip 104 is a design decision between the stability of cover 10, which is increased with a long lip, and ease of removal of cover 10 with a shortened lip, which places the fulcrum of the lever closer to the load.

The positioning of magnet 18, or other securing means, and the use of the edges of the raised lip as a fulcrum as described above represent presently preferred embodiments. It will be apparent to one of skill in the art that the securing means and the fulcrum need not be embedded in a raised lip, and can be freely embedded in the sidewalls of the cavity, obviating the need for a raised lip. This suggested embodiment increases manufacturing complexity, increases the size of the cavity, and decreases the stability of the lid while mounted to the cavity. Additionally, a raised lip that does not extend through three sidewalls can also be employed, so long as a proper fulcrum is provided, and the securing means is supported. The securing means can be mounted flush with the surface of the raised lip, or slightly offset, so as to trade manufacturing difficulty with seamless mounting of the cover 10.

Additionally, it may be desirable to employ non-magnetic securing means, such as re-usable tape or an adhesive. Replacement of the magnet also allows the use of a non-magnetic cover plate 10.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A tool kit, for string changing and maintenance of a stringed musical instrument, said tool kit comprising:

a tool case having a tool receiving portion and a lid, said lid being movable between a closed position, in which access to said tool receiving portion is prevented, and an open position, in which access is provided to tools in said tool receiving portion, and said bottom portion having shaped recesses for accepting specific tools;

a cutting tool;

a winding tool;

a tuning aid;

at least one screwdriver bit; and a holder for screwdriver bits.

2. The tool kit as recited in claim 1, wherein said winding tool has a hollow handle with a removable end cap, said hollow handle and removable end cap, when attached to said handle, defining a container for storage of said at least one screwdriver bit.

3. The tool kit as recited in claim 2, wherein said end cap of said winding tool has a slotted recess for removal of bridge pins from a musical instrument.

4. The tool kit as recited in claim 2, wherein said winding tool has a curved portion to prevent contact with adjacent machine heads when said winder is applied to a machine head for winding a string.

5. The tool kit as recited in claim 1, wherein said winding tool has a hollow handle with a removable end cap, said hollow handle and removable end cap, when attached to said handle, defining a container for storage of said at least one screwdriver bit and said holder for screwdriver bits.

6. The tool kit as recited in claim 5, wherein said end cap of said winding tool has a slotted recess for removal of bridge pins from a musical instrument.

7. The tool kit as recited in claim 5, wherein said winding tool has a curved portion to prevent contact with adjacent machine heads when said winder is applied to a machine head for winding a string.

8. The tool kit as recited in claim 5, wherein said screwdriver bit holder is in two parts, which can be attached together, to farther facilitate the storage of said screwdriver bit holder in said winder handle.

9. The tool kit as recited in claim 1, wherein said cutting tool is a cutting pliers.

10. The tool kit as recited in claim 1, wherein said holder for screwdriver bits has a longitudinal internal hole for receiving one of said at least one screwdriver bits.

11. The tool kit as recited in claim 10, wherein said holder for screwdriver bits has a locking means for locking said one of said at least one screwdriver bits in said longitudinal hole.

12. The tool kit as recited in claim 1, wherein said tool kit further comprises a container for plectrums.

13. The tool kit as recited in claim 12, wherein said container for plectruns is a stainless steel box.

14. The tool kit as recited in claim 1, wherein said lid is held in said closed position by magnetic means arranged on said lid and said bottom portion.

15. The tool kit as recited in claim 1, wherein said tuning aid is a tuning fork.

16. A guitar servicing tool, comprising:

a winding tool with a head, for placing over a string tuning screw;

at least one screwdriver bit;

a holder for screwdriver bits;

wherein said winding tool has a handle with a slotted recess configured for removal of bridge pins from a musical instrument.

17. The tool kit as recited in claim 16, wherein said handle is hollow, thereby providing a container for storage of said at least one screwdriver bit and said holder for screwdriver bits.

18. The tool kit as recited in claim 17, wherein said handle has a removable end cap and said slotted recess is provided in said end cap.

19. The tool kit as recited in claim 16, wherein said winding tool has a curved portion to prevent contact with adjacent machine heads when said winding tool is applied to a machine head for winding a string.

20. The tool kit as recited in claim 16, wherein said screwdriver bit holder is in two parts, which are attached together, to further facilitate the storage of said screwdriver bit holder in said winder handle.

* * * * *